US011108198B2

(12) United States Patent
Dubois et al.

(10) Patent No.: US 11,108,198 B2
(45) Date of Patent: Aug. 31, 2021

(54) COAXIAL CONNECTOR COMPRISING A SHUNT

(71) Applicant: COMMISSARIAT A L'ENERGIE ATOMIQUE ET AUX ENERGIES ALTERNATIVES, Paris (FR)

(72) Inventors: Jean-Luc Dubois, Le Barp (FR); Bruno Cassany, Hostens (FR); Jerome Ribolzi, Andernos (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 246 days.

(21) Appl. No.: 16/085,235

(22) PCT Filed: Mar. 16, 2017

(86) PCT No.: PCT/EP2017/056278
§ 371 (c)(1),
(2) Date: Sep. 14, 2018

(87) PCT Pub. No.: WO2017/158111
PCT Pub. Date: Sep. 21, 2017

(65) Prior Publication Data

US 2019/0081444 A1 Mar. 14, 2019

(30) Foreign Application Priority Data

Mar. 17, 2016 (FR) ..... 1652266

(51) Int. Cl.
*H01R 24/38* (2011.01)
*H01R 24/48* (2011.01)
(Continued)

(52) U.S. Cl.
CPC ..... *H01R 24/48* (2013.01); *H01R 9/05* (2013.01); *H01R 13/53* (2013.01); *H01R 24/44* (2013.01); *H01R 24/52* (2013.01)

(58) Field of Classification Search
CPC ..... H01R 24/48; H01R 24/44; H01R 24/52; H01R 9/05; H01R 24/38; H01R 24/40; H01R 24/42; H01R 13/53; H01R 13/46
(Continued)

(56) References Cited

U.S. PATENT DOCUMENTS 2,684,665 A * 7/1954 Tognola ..... H01T 13/52 315/46
4,544,984 A * 10/1985 Kawanami ..... H01R 24/542 361/119
(Continued)

FOREIGN PATENT DOCUMENTS

EP 0259180 A2 3/1988
EP 0840413 A1 5/1998

OTHER PUBLICATIONS

U.S. Appl. No. 15/302,710, filed Oct. 7, 2016, now U.S. Pat. No. US 2017/003686 A1, Cadilhon, B. et al.
(Continued)

*Primary Examiner* — Harshad C Patel
(74) *Attorney, Agent, or Firm* — Oblon, McClelland, Maier & Neustadt, L.L.P.

(57) ABSTRACT

A coaxial connector and a method for manufacturing such a coaxial connector. The coaxial connector includes: a conductive core; a metal shielding surrounding the core; a dielectric arranged between the core and the shielding to insulate them electrically with respect to one another; and a shunt to supply a resistive bridge between the core and the shielding. The shunt includes: a graphite element positioned between the core and the shielding; and a first and a second metal deposit to supply an electrical and mechanical con-
(Continued)

nection between the graphite element and respectively the core and the shielding. A coaxial cable and an electrical device can both include such a coaxial connector.

16 Claims, 5 Drawing Sheets

(51) Int. Cl.
*H01R 13/53* (2006.01)
*H01R 24/52* (2011.01)
*H01R 24/44* (2011.01)
*H01R 9/05* (2006.01)

(58) Field of Classification Search
USPC ..... 439/100; 361/111
See application file for complete search history.

(56) References Cited

U.S. PATENT DOCUMENTS 4,720,271 A * 1/1988 Grange ..... H01R 24/52 439/271
4,952,173 A * 8/1990 Peronnet ..... H01R 24/48 439/583
5,657,196 A * 8/1997 Chaudhry ..... H01R 24/48 361/111
5,724,220 A * 3/1998 Chaudhry ..... H01R 24/48 361/103
5,768,084 A * 6/1998 Chaudhry ..... H01R 24/48 361/120
6,636,407 B1 * 10/2003 Ryman ..... H01P 1/202 361/113
2013/0244481 A1 9/2013 Holland et al.
2013/0244509 A1 9/2013 Holland
2014/0315428 A1 10/2014 Holland et al.
2015/0263463 A1 9/2015 Holland

OTHER PUBLICATIONS

International Search Report dated May 22, 2017, in PCT/EP2017/056278, filed Mar. 16, 2017.
French Search Report dated Aug. 12, 2016, in FR 1652266, filed Mar. 17, 2016.

* cited by examiner

COAXIAL CONNECTOR COMPRISING A SHUNT

TECHNICAL FIELD

The invention relates to the field of strong current measurements and more particularly relates to shunts and other shunt resistors allowing for such measurements by shunting a portion of the current.

The invention more particularly relates to a coaxial connector comprising such a shunt, a coaxial cable comprising such a connector and a method for manufacturing a coaxial connector comprising a shunt.

PRIOR ART

In the framework of certain measurements that bring about high current discharges in short periods of time, it is known to use coaxial cables and connectors comprising shunts in order to evacuate a portion of the current to the ground. In this way, it is possible to take these measurements while still guaranteeing the protection of the measuring devices.

It is reminded that in the technical field of measuring high current, a shunt is, by definition, a resistive element of very low impedance, such as an electrical conductor, allowing the current to pass from one point to another if an electrical circuit by using very little energy. As such in the framework of the invention, a shunt is a resistive element that makes it possible to provide a resistive bridge between a core and a shielding of a coaxial connector.

Such coaxial connectors are known and in particular by those marketed by T&M RESEARCH PRODUCTS under the reference SDN-414.

Such a coaxial connector comprises:

- a conductive core,
- a metal shielding surrounding the core,
- a dielectric arranged between the core and the shielding in order to insulate them electrically with respect to one another, and
- a shunt to provide a resistive bridge between the core and the shielding.

This type of connector has the advantage of making it possible to protect certain electrical devices during the measuring of intense current over a period of time that can be relatively short this by shunting a portion of the current to the ground plane. This type of connector as such comprises good current resistance (greater than 10,000A in nanosecond pulse) for a relatively substantial bandwidth, since it can reach 2 GHz.

This type of connector however has a certain number of disadvantages. Indeed, the shunt that it contains does not have a constant frequency response and as such has a higher resistance for frequencies higher than 100 MHz. In addition, the integration of the shunt in this type of connector is entirely relative, since the volume of the connector is largely greater than that of a conventional coaxial connector, and this integration is done to the detriment of the bandwidth which does not exceed 2 GHz.

DISCLOSURE OF THE INVENTION

This invention aims to overcome several of these disadvantages and as such has more particularly for purpose to provide a coaxial connector comprising a shunt, the shunt having a bandwidth greater than 12 GHz while still offering an equivalent current resistance and a compactness that is greater than that of coaxial connectors of prior art that comprise a shunt.

The invention for this purpose relates to a coaxial connector comprising a shunt, said connector comprising:

- a conductive core,
- a metal shielding surrounding the core,
- a dielectric arranged between the core and the shielding in order to insulate them electrically with respect to one another, and
- a shunt for providing a resistive bridge between the core and the shielding, the shunt comprising:

- a graphite element positioned between the core and the shielding, and
- a first and a second metal deposit in order to supply an electrical and mechanical connection between the graphite element and respectively the core and the shielding, each one of the first and second metal deposits being an electrolytic deposit.

Such a graphite element allows the shunt to benefit from an optimised bandwidth. Indeed, at high frequency, the current flows to the surface of the conductive materials and over a thickness corresponding to the skin thickness. The graphite, through its low electrical conductivity, has a substantial skin thickness. The graphite element is therefore little influenced by this phenomenon and therefore makes it possible to obtain a bandwidth greater than 12 Ghz. What is more, due to this relative size of its skin thickness, the graphite element makes it possible to obtain a homogeneous behaviour of the shunt over a frequency range from 0 to 12 GHz.

Note in addition that with such a device, the integration of the shunt is optimised since the latter is directly integrated into the coaxial connector. This integration is done without any detrimental influence as to the mechanical resistance of the graphite element with respect to the rest of the connector and on the electrical characteristics of the shunt this due to the use of the two metal deposits. In this way, the coaxial connector, with the shunt that it contains, can be provided on an electrical device, the connector then being intended to allow for the connection to a coaxial cable; as well as a coaxial cable, the coaxial connector then being intended to allow for the connection to an electrical device, even a coaxial connector.

Each one of the first and second metal deposits can be made from a metal selected from the group comprising copper, silver, gold, nickel, chrome, zinc, tin and lead.

Such metals make it possible to provide good contact between the graphite element and respectively the core and the shielding of the connector.

At least one of the first and second metal deposits can be formed from copper.

Copper is particularly suited in order to make it possible to put into contact the graphite element with respectively the core and the shielding this through its good electrical conduction properties and due to the fact that the core, and even also the shielding, are usually made of copper.

At least one of the first and second metal deposits can comprise at least two layers of metal, each one of the layers being made from a metal selected from the group comprising copper, silver, gold, nickel, chrome, zinc, tin and lead.

With such metal deposits comprising at least two layers, it is possible to provide a first layer in order to provide good conduction, such as a layer of copper, between the graphite element and respectively the core and the shielding, and a second layer making it possible to protect the first layer. This second layer can either act as a sacrificial anode, by being for example formed from zinc, or act as a protective layer as such, by being for example formed from chrome.

The coaxial connector can further comprise a second protective layer in order to protect at least one of the first and second metal deposits.

Such a second layer separate from the first and second metal deposits can limit, and even prevent any contact of these metal deposits with air or water which could corrode them.

The graphite element can have the form of a graphite plate sized to be positioned between the core and the shielding.

The graphite element can have a thickness between 5 and 250 μm, preferably between 10 and 100 μm.

Such a graphite element is particularly suited to have a relatively low resistance and provide good current resistance this with a relatively high bandwidth, while still occupying a small volume compatible with integration into a coaxial connector.

The shielding can include a metal connection endpiece shaped to cooperate with a complementary endpiece of another coaxial connector according to a cooperation of the male/female type, the graphite element being positioned between the core and the metal endpiece, the second metal deposit providing an electrical and mechanical connection between the graphite element and the metal endpiece.

Such a coaxial connector is particularly suited to authorize the connection to a coaxial cable or allow, when the connector is provided on a coaxial cable, the connection onto an electrical device.

The coaxial connector can be a connector of the SMA type, the connection endpiece being a threaded end piece.

Such a coaxial connector particularly benefits from comprising a shunt according to the invention due to its applications which are generally at frequencies higher than 2 GHz.

The invention also relates to a coaxial cable comprising at least one coaxial connector according to the invention.

Such a coaxial cable makes it possible to benefit from the advantages of the invention this regardless of the electrical device to which it is connected.

The invention also relates to an electrical device comprising at least one coaxial connector according to the invention.

Such an electrical device benefits from the advantages linked to the use of a coaxial connector according to the invention.

The invention also relates to a method for manufacturing a coaxial connector comprising a shunt, the method comprising the following steps:

- supplying of a coaxial connector comprising
  - a conductive core,
  - a shielding surrounding the core,
  - a dielectric arranged between the core and the shielding in order to insulate them electrically with respect to one another, and
- supplying of a graphite element,
- installing the graphite element on the coaxial connector positioned between the core and the shielding, and
- forming of a first and of a second metal deposit in order to supply an electrical and mechanical connection between the graphite element and respectively the core and the shielding, the forming of the first and second metal deposit being carried out by electrolysis.

Such a method allows for the manufacture of a coaxial connector that benefits from the advantages linked to the invention.

A step of protecting a face of the graphite element can be provided by means of a first protective layer, said step of protecting a face of the graphite element being prior to the step of forming the first and second electroconductive deposit, and wherein the step of forming the first and second metal deposit consists in carrying out an electrolytic deposit between the graphite element and respectively the core and the shielding, the face of the graphite element being protected by the first layer.

With such a protective layer, it is possible to perfectly locate the positioning of the first and second metal deposit and therefore to correctly define the resistance offered by the graphite element.

A step of depositing a second protective layer can further be provided in order to protect the first and second metal deposits.

With such a step of protection, it is possible to protect the first and the second metal deposit from corrosion.

During the step of supplying the graphite element, the graphite element can be oversized in order to be positioned, and wherein the step of installing the graphite element comprises a substep of inserting the graphite element via shearing in such a way as to place the latter between the core and the shielding with a suitable sizing.

Such a step of inserting via shearing makes it possible to obtain a graphite element that is perfectly sized for the latter to be placed between the core and the shielding.

BRIEF DESCRIPTION OF THE DRAWINGS

This invention shall be better understood when reading the description of embodiments, given purely for the purposes of information and in a non-limiting manner, in reference to the accompanying drawings wherein.

Identical, similar or equivalent parts of the various figures bear the same numerical references in so as to facilitate passing from one figure to the other.

The various portions shown in the figures are not necessarily shown according to a uniform scale, in order to make the figures more readable.

The various possibilities (alternatives and embodiments) must be understood as not being exclusive of one another and can be combined together.

DETAILED DESCRIPTION OF PARTICULAR EMBODIMENTS

Figure 1A:
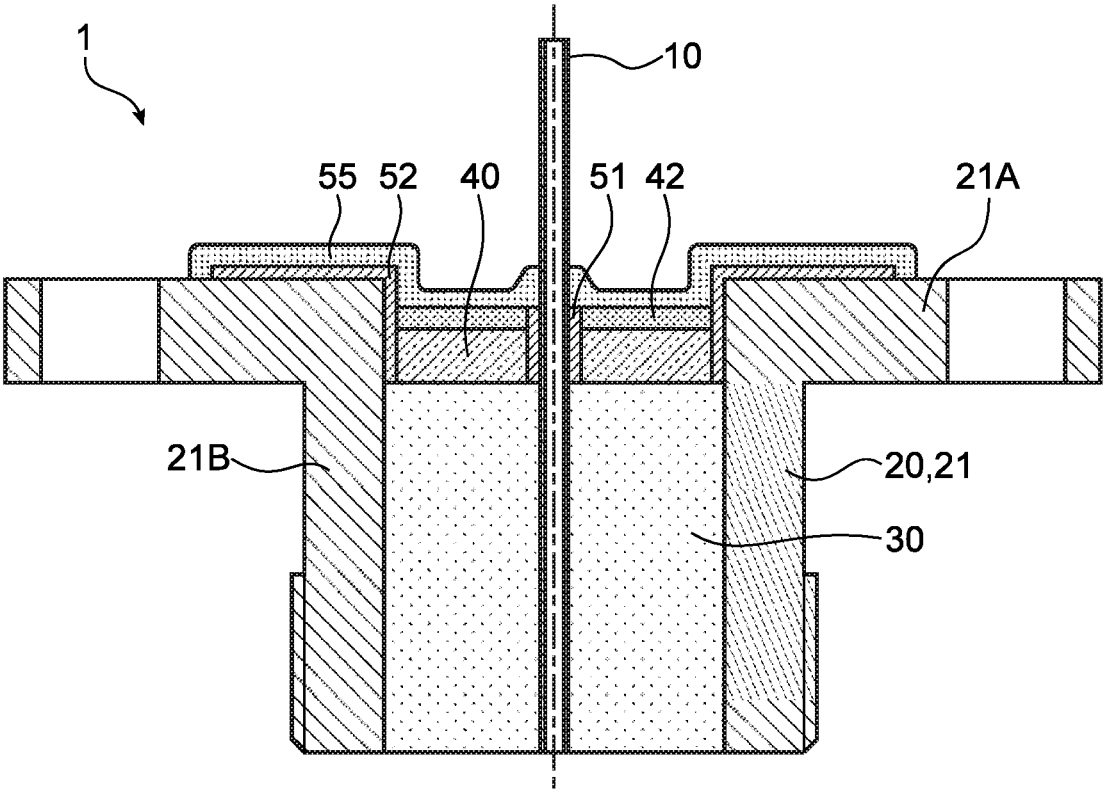
FIGS. 1A and 1B are respectively a cross-section view and a front view of a coaxial connector comprising a shunt according to the invention.
Figure 1B:
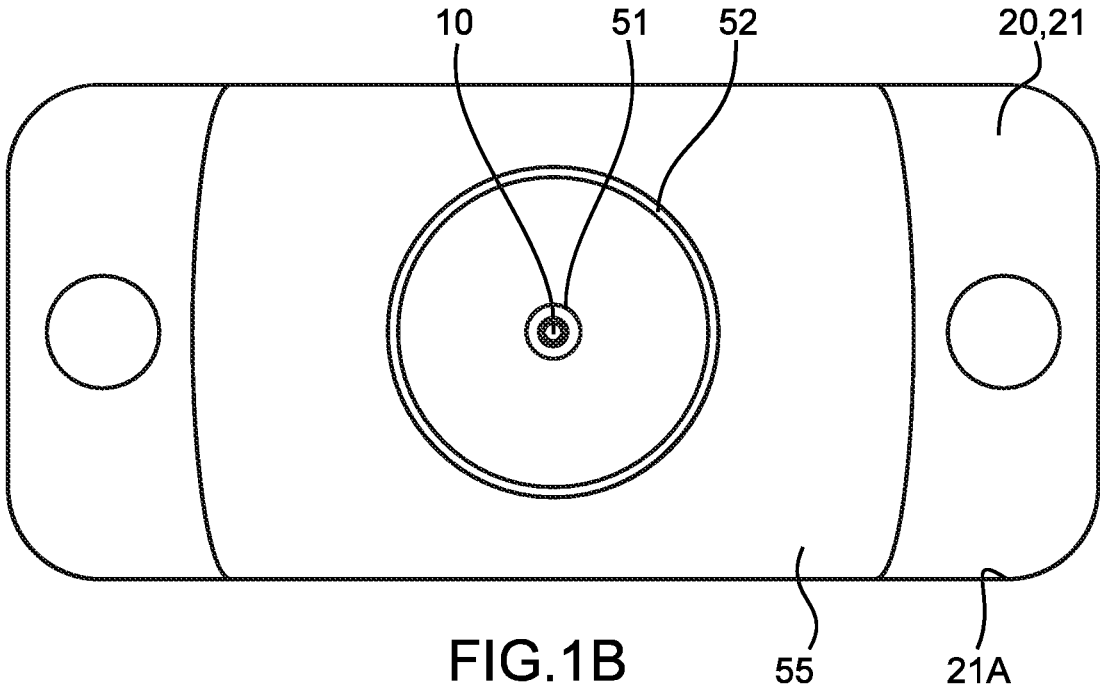

FIG. 1 shows a coaxial connector 1 comprising a shunt according to the invention.

Such a coaxial connector 1 comprises:

- a conductive core 10,
- a metal shielding 20,
- a dielectric 30 arranged between the core and the shielding in order to insulate them electrically with respect to one another,
- a graphite element 40 arranged between the core and the shielding 20, the graphite element 40 having a first and a second face, the second face being coated with a first protective layer 42,
- the first protective layer 42,
- a first and a second metal deposit 51, 52 in order to supply an electrical and mechanical connection between the graphite element 40 and respectively the core 10 and the shielding 20, and
- a second protective layer 55 in order to protect the first and second metal deposits 51, 52.

Figure 2:
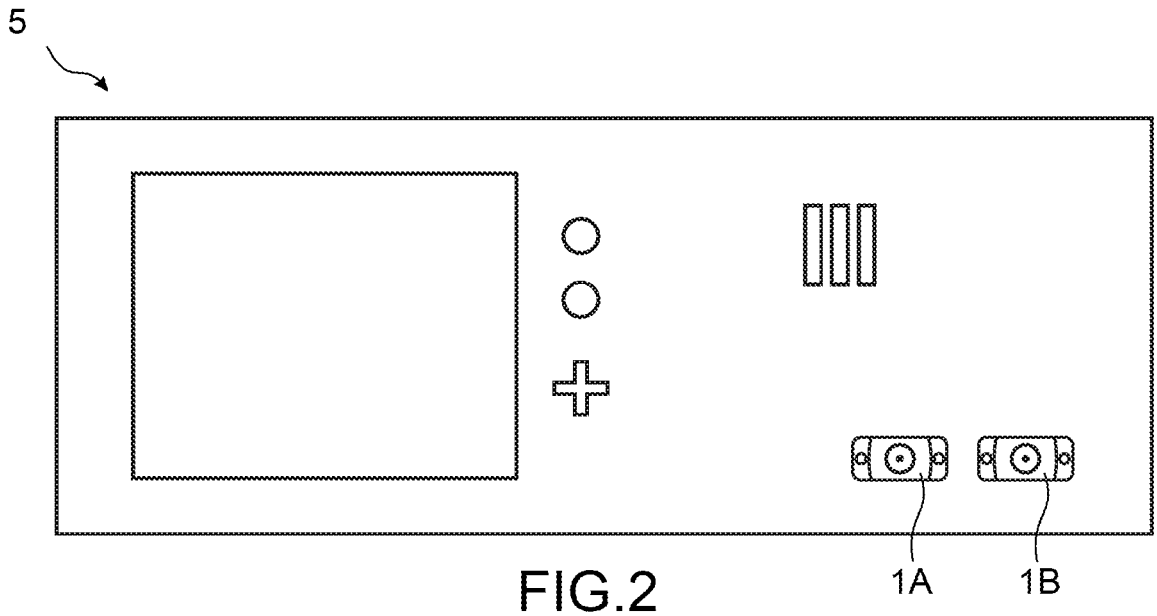
FIG. 2 shows an electrical device comprising two coaxial connectors according to the invention such as shown in FIG. 1.
Figure 3:
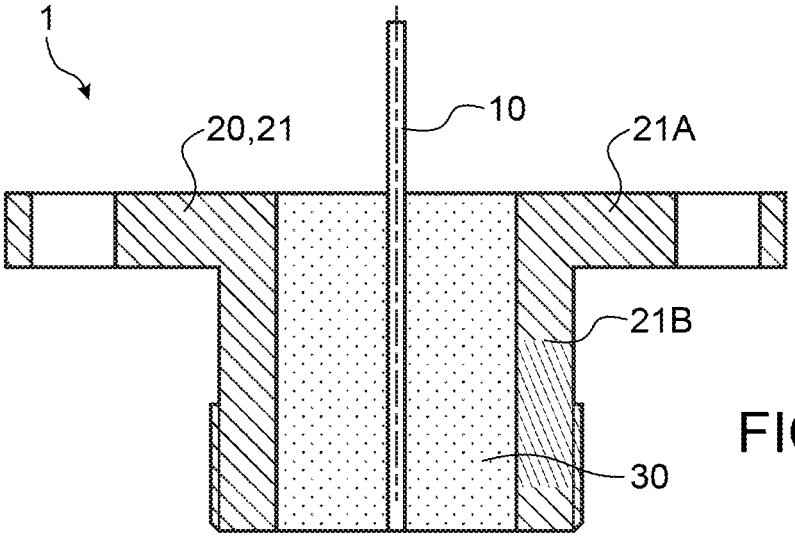
FIG. 3 is a cross-section view of a coaxial connector before the placing of a shunt according to the invention.

In the coaxial connector shown in FIG. 1, being a coaxial connector 1 of the female type, the core 10 is provided by a hollow conductor intended to receive the end of the core of a male connector. This same coaxial connector 1 is a connector of the SMA type ("SubMiniature version A" and in compliance with the standard IEC), such as shown in FIG. 3, intended to be provided on an electrical device, such as shown in FIG. 2, in order to allow for the connection with a coaxial cable comprising a complementary male connector.

As such, the shielding 20 of the coaxial connector 1 comprises a metal connection endpiece 21. This connection endpiece 21 has a substantially flat rectangular base 21A, provided with a central orifice, and a cylindrical hollow body 21B of revolution extending from the base 21A with its axis of revolution substantially perpendicular to the base 21A. The base 21A is provided on either side of the central orifice with two peripheral screw passages in order to allow for the mounting of the coaxial connector on an electrical device 5.

The cylindrical body 21B extends from the base 21A with the hollow of the cylindrical body extending the central orifice of the base 21A. In this way, the housing formed by the hollow of the cylindrical body 21B and by the central orifice of the base 21A is able to house the dielectric 30 and partially the core 10.

The cylindrical body is provided on the surface of its outer perimeter and opposite the base 21A with a threading. Such a threading allows for the screwing of the male connector provided on a coaxial cable on the connection endpiece 21 and therefore the coaxial connector. In this way, the connection endpiece 21 is shaped to cooperate with a complementary endpiece of another connector according to a cooperation of the male/female type.

The dielectric 30 is housed in the connection endpiece 21 by being inserted between the core 10 and the connection endpiece 21. More precisely, the dielectric 30 fills the inner volume of the cylindrical body 21B left free by the core 10 by offering a mechanical maintaining for the core 10. The dielectric 30 has a substantially cylindrical of revolution shape provided with a central passage in order to house the core 10. The core 10 is positioned with regards to the dielectric 20 in such a way that:

- the core 10 is flush with the dielectric 30 on the base of the latter which is opposite the base 21A, and
- the core 10 protrudes from the dielectric 30 on the base of the latter which is located in the extension of the base 21A, such a protrusion making it possible to connect the core 10 to, for example, a treatment circuit, not shown, of the electrical device 5 provided with said coaxial connector 1.

The dielectric 30 is made from a dielectric material, such as a polyethylene or a polytetrafluoroethylene, which can be solid or in the form of a foam.

Figure 4:
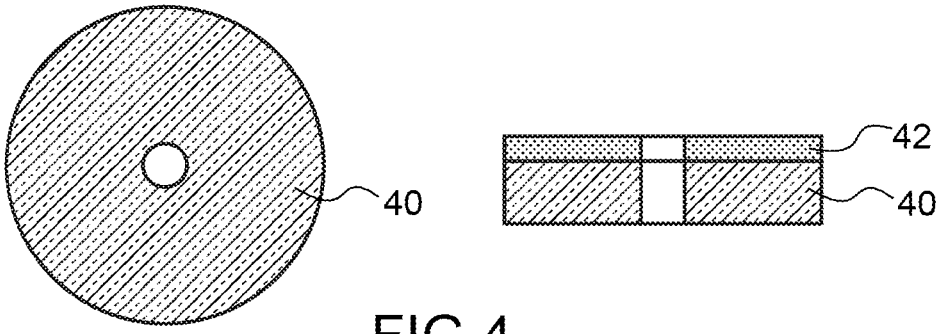
FIG. 4 shows a front view and a cross-section view of a graphite element intended for the forming of a shunt in order to equip a coaxial connector such as shown in FIG. 3, FIGS. 5A and 5B show as a cross-section the setting in place of the graphite element shown in FIG. 4 on the coaxial connector shown in FIG. 3 this by carrying out a shearing of the graphite element in order to perfect its size with regards to the coaxial connector.

The graphite element 40 has, as shown in FIG. 4 the form of a graphite disc provided with a central opening for the passage of the core 10. The graphite element is sized to be positioned in the central opening of the base 21A between the base 21A and the core 10. The thickness of the graphite element 40 is between 10 and 100 μm.

The graphite element 40 comprises the first circular face, through which it is in contact with the dielectric, and the second face, also circular, which is opposite the dielectric. The first protective layer 42 covers the second face of the graphite element.

The first layer 42 is made from a dielectric material, such as a dielectric compound with a polymer or elastomer base this so as to protect the second face of the graphite element 40 during the deposition of the first and of the second metal deposit 51, 52. This same first layer 42 has a resistance to acids suited for offering protection of the second face of the graphite element 40 over a duration at least equal to the duration of the deposition of the first and second metal deposits, i.e. typically from 5 to 6 h.

As such, for example, the first layer 42 can be made in the epoxy resin marketed by the company RS Components® under the reference RS-196-5245® and the name "Tamper Evident Seal #196-5245".

It can be noted that, according to an alternative of the first embodiment, the graphite element 40 may not have the first protective layer 42.

The first and the second metal deposit 51, 52 are arranged in such a way as to be inserted between the graphite element 40 and respectively the core 10 and the base 21A. As such, the first metal deposit 51 is inserted between the graphite element 40 and the core 10 and makes it possible to provide an electrical and mechanical connection between them. Likewise, the second metal deposit 52 is inserted between the graphite element 40 and the base 21A and makes it possible to provide an electrical and mechanical connection between them.

More precisely, as shown in FIG. 1, the first metal deposit 51 fills at least partially the space between the graphite element 40 and the core 10, and the second metal deposit 52 fills at least partially the space between the graphite element 40 and the base 21A and covers a portion of the surface of the base 21A. The portion of the surface of the base 21A is a free portion of the two peripheral screw passages. The first and second metal deposits 51, 52, in this first embodiment, are both made from a metal which is preferably copper due to its conductive properties.

The graphite element 40 and the first and second metal deposits 51, 52 together form a shunt in order to provide a resistive bridge between the core and the shielding. Indeed, the graphite element 40, by being arranged between the core 10 and the shielding 20, makes it possible to deliver a substantial portion of the current transiting in the core to the shielding 20 and therefore to the ground plane to which is connected the shielding 20 (in particular by the base 21A which is generally screwed to the frame of the electrical device 5).

In order to protect the first and second metal deposits 51, 52 from any oxidation, the first and second metal deposits 51, 52 are covered with the second protective layer 55.

The second layer 55 is a watertight and airtight layer. This second layer 55 can as such be made from a compound having watertight and airtight properties with a polymer or elastomer base. As such for example, the second layer 55 can be made from the epoxy resin marketed by the company RS Components® under the reference RS-159-3957° and the name "High strength epoxy resin".

Such a coaxial connector 1 can therefore as shown in FIG. 2, be installed on an electrical device 5, such as a measuring device. To do this the coaxial connector 1 is introduced into an opening of the frame of the electrical device 5 and screwed to the latter by means of screw passages arranged in the base 21A. The core 10 is then provided with a cable in order to connect it to a measuring circuit, not shown. The frame of such an electrical device 5 forms, in a usual configuration, a ground plane. As such the shielding 20 is itself connected to the ground of the electrical device 5. In this way, in case of discharge of a substantial current over short period of time, i.e., for example, 5 kA over a duration of 1 ns, a substantial portion of the current passing through the core 10 will be shunted by the graphite element 40 in the direction of the ground plane.

Figure 5A:
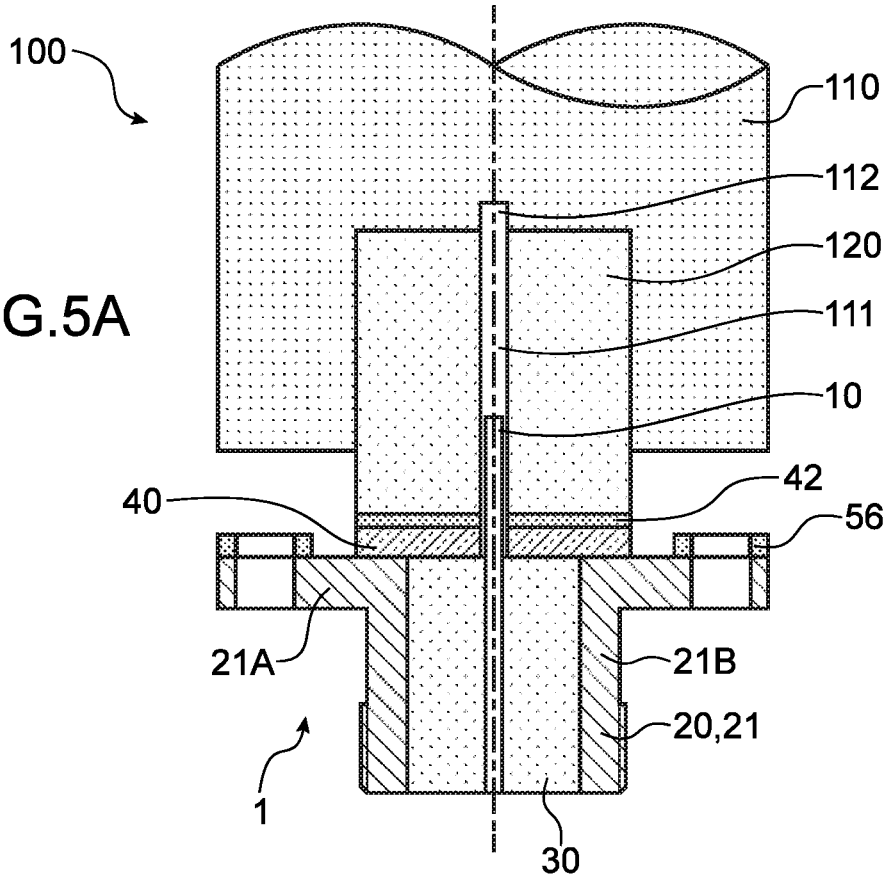
Figure 5B:
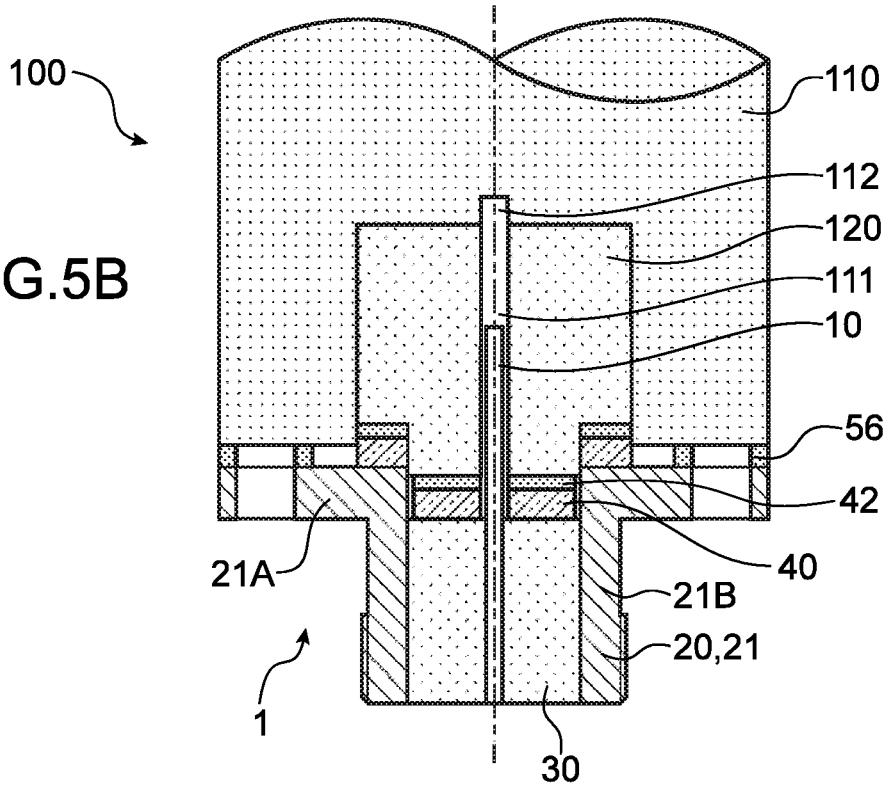
Figure 6:
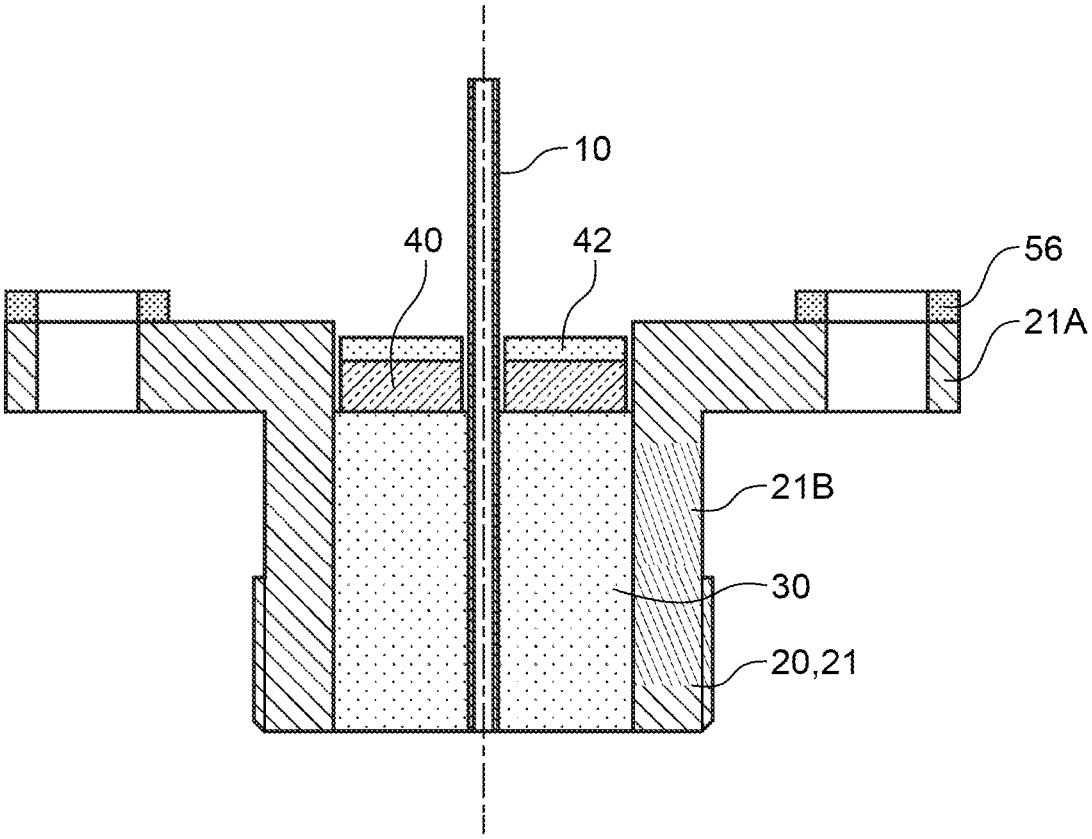
FIG. 6 shows the step of protecting the coaxial connector shown in FIG. 4B in such a way as to protect certain portions of the coaxial connector during the setting in place of metal deposits.
Figure 7:
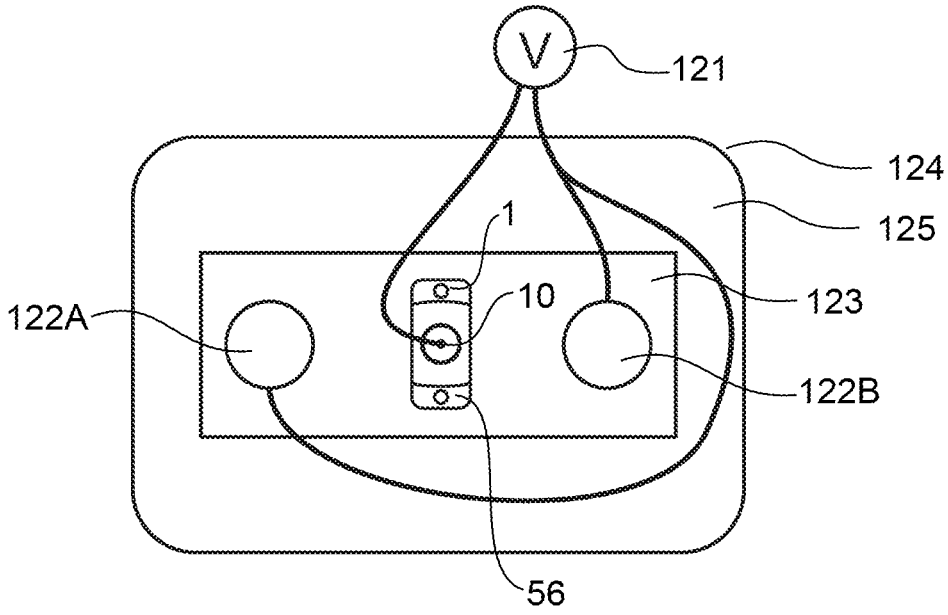
FIG. 7 shows the system used to carry out the electrolytic deposits between the graphite element and the rest of the coaxial connector.
Figure 8:
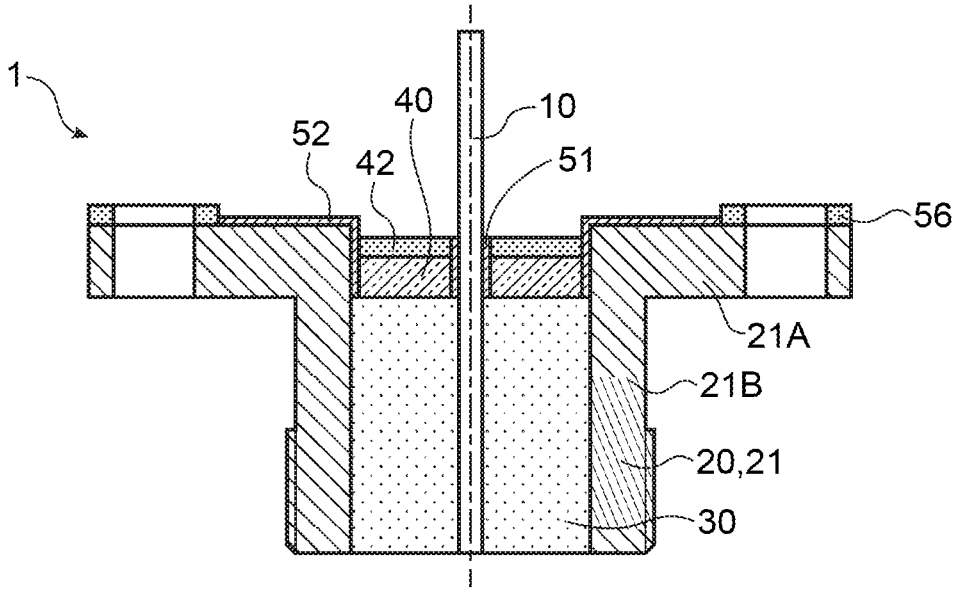
FIG. 8 shows the coaxial connector shown in FIG. 6 after carrying out electrolytic deposits by means of the system shown in FIG. 7.

Such a coaxial connector 1 can be manufactured by means of a method of manufacturing of which the main steps are shown in FIGS. 3 to 9 and FIG. 1. Such a method comprises the following steps:

- supplying of a coaxial connector 1 standard, such as the female SMA connector shown in FIG. 3,
- supplying of the graphite element 40 with its second face coated with the first protective layer 42,
- inserting via shearing, as shown in FIGS. 5A and 5B of the graphite element 40 between the core 10 and the base 21A in such a way that the graphite element 40 is sized in order to be placed between the core 10 and the base 21A,
- applying, as shown in FIG. 6, of a third protective layer 56 on the base 21A on its screw passages in such a way as to protect the portions of the surface of the base that include the screw passages,
- forming of the first and of the second metal deposit between the core 10 and the graphite element 40 and between the base 21 and the graphite element 40 in such a way as to provide the electrical and mechanical connection between the latter, with this forming being carried out during an electrolytic deposition such as shown in FIG. 7 by means of an electrolytic solution 125,
- neutralising of the electrolytic solution 125 by soaking the connector 1 in a bath of sodium hydroxide in order to neutralize any traces of electrolytic solution 125 which could cause an oxidation of the first and second metal deposits 51, 52 and to obtain the coaxial connector 1 as shown in FIG. 8,
- suppressing of the third layer 56 and
- depositing of the second protective layer 55 in order to protect the first and second metal deposits 51, 52 and in order to obtain the coaxial connector 1 comprising a shunt according to the invention.

During this method, the step of supplying the graphite element 40 can comprise the following substeps:

- supplying of a graphite plate of which the thickness is between 5 and 250 μm, even 10 and 100 μm, and for example 75 μm,
- application of the first protective layer 42 on one of the faces of the graphite plate,
- cutting in the graphite plate of a graphite disc of a diameter greater than that of the central orifice of the base 21A, and
- arranging of the central opening in the graphite disc so as to supply as such the graphite element 40 provided with the first layer 42, such as shown in FIG. 4.

It can be noted that in order to provide the proper unfolding of the method of manufacturing the coaxial connector 1, it is preferable that during the step of supplying the standard coaxial connector 1 a substep of cleaning/degreasing the connector be provided. Such a substep of cleaning/degreasing the connector can for example consist in soaking the connector in a bath of phosphoric acid for a duration of 5 min, rinsing it in water, and drying it.

The step of inserting via shearing of the graphite element 40 between the base 21A and the core 10 can be carried out, as shown in FIGS. 5A and 5B, by means of a suitable tool 100. This tool 100 comprises a substantially cylindrical body 110 comprising a cylindrical cavity 111 of revolution and a cylinder 120 of revolution made of a deformable material in order to exert a homogeneous pressure force over the entire surface of the graphite element, said cylinder 120 being partially housed in the cylindrical cavity 111.

The body 110 is made from a relatively rigid material in relation to the cylinder 112, such as for example a thermoplastic elastomer, a metal or wood. The body 110 can as such be made from vinyl polychloride (known more commonly abbreviated as PVC). The body 110 is provided with the cylindrical cavity 111 which opens onto one of its faces. The cylindrical cavity 111 is extended in the body 110 by a tube 112 that can possibly house a portion of the core 10 during the step of inserting via shearing of the graphite element 40.

The cylinder 120 has an outer diameter substantially equal to or slightly less than the inner diameter of the cylindrical cavity 111 of the body 101 in such a way as to allow for the installation thereof in this latter cylindrical cavity 111. This same diameter of the cylinder 120 is preferably greater than or equal to that of the graphite element 40 before the inserting thereof via shearing and is strictly greater than or equal to the diameter of the central orifice of the base 21A. The height of cylinder 120 is greater than the depth of the cylindrical cavity 111 this in order to allow for the deformation of the cylinder 120 during the inserting of the graphite element 40. The height/depth difference between the cylinder 120 and the cylindrical cavity 111 can as such be between 1 and 3 mm, and preferably between 1.25 and 2 mm, this difference able to typically be 1.5 mm. The cylinder 120 therefore protrudes from the body 110 of this height/depth difference.

The cylinder 120 is pierced at its centre and along its axis of symmetry by a passage for the core 10 which is extended by the tube 112 as such providing that no stress is applied to the core 10 during the inserting via shearing of the graphite element 40.

The step of inserting the graphite element 40 with such a tool is carried out by means of the following substeps:

- installing the graphite element 40 on the coaxial connector 1, the core 10 being inserted into the central opening of the graphite element 40 and the first face being placed on the dielectric 30,
- setting in place of the tool 100 with the cylinder 120 bearing against the graphite element 40 and the core 10 introduced into the passage of the cylinder 120 and, according to its length, the tube 112 of the body 110, as shown in FIG. 5A, and
- applying of a pressure force on the body 120 in a direction going from the body to the coaxial connector 1 in order to cause the cylinder 120 and the dielectric 30 to be deformed with insertion and shearing of the graphite element 40.

Indeed, during the application of the pressure force, the cylinder 120 has a central portion facing the central orifice of the base 21A, and therefore the dielectric 30, and a peripheral portion facing the base 21A. The base 21A being metallic, it has a relatively substantial rigidity with respect to the cylinder 120, while the dielectric 30 and the cylinder have an equivalent rigidity. As such during the application of the pressure force the deformations of the central and peripheral portions will therefore be different. Indeed, as shown in FIG. 5A, the peripheral portion will sag in order to compensate the displacement of the body in the direction of the coaxial connector while for the central portion, the compensation of the displacement is done via a sagging distributed over both the cylinder and over the dielectric 30. This results in a relative displacement, and therefore a shearing, of the portion of the graphite element 40 arranged on the dielectric 20 in relation to the portion of the graphite element 40 that is arranged on the base 21A.

The graphite element 40 sheared as such and displaced inside the central orifice of the base 21A, is inserted between the base 21A and the core 10 with an adjusted sizing.

During the step of applying the third protective layer 56 on the base on its screw passages, the protective layer can be made from a dielectric material, resistant to acidic environments during the duration of the electrolytic deposition, and can be made from the same material as that of the first layer 42. As such for example, the third layer 56 can also be made from the epoxy resin marketed by the company RS Components® under the reference RS-196-5245® and the name "Tamper Evident Seal #196-5245".

The step of forming the first and the second metal deposit 51, 52 is carried by means, as shown in FIG. 7 of an electrolysis cell 120 comprising:

- a source of current 121 in order to apply a voltage difference,
- a first and second electrode 122A, 122B made of copper, the first and second electrodes 122A, 122B being connected to the positive terminal of the source of current 121, while the core 10 of the coaxial connector 1 is connected to the negative terminal,
- a support 123 for supporting the first and second electrodes 122A and 122B and the coaxial connector 1, the support 123 housing the cylindrical body 21B of the connection endpiece 21 in such a way as to protect the latter and a portion of the base 21A during the electrolytic deposition,
- an electrolysis tray 124 containing the electrolytic solution 125, the latter being a slightly acid solution (for example 8% acetic acid or boric acid) supersaturated with copper sulphate or copper nitrate.

The step of forming can as such comprise the following substeps:

- installing of the coaxial connector 1 and of the first and second electrodes on the support 123,
- immersing of the support 123 and of the elements that it supports in the solution 125, and
- applying of the voltage between the first and second electrodes 122A, 122B and the core 10 this by means of the source of current 10, in such a way as to carry out an electrolytic deposition in order to form the first and the second metal deposit 51, 52.

Due to the connection of the core 10 to the source of current 121, the electrolytic deposition takes place in a first step between the core 10 and the graphite element 40 as such making it possible to fill the space between them and to form the first metal deposit 51. Once the electrical connection between the core 10 and the graphite element 40 is established by means of the first deposit, the surface of the graphite element 40 being protected by the first layer 42, the electrolytic deposition takes place from the periphery of the graphite element 40 in the direction of the base 21A. As such, the electrolytic deposition takes place in a second step between the graphite element 40 and the base 21A by making it possible to fill the space between them and to form the second metal deposit 52. Once the electrical connection between the graphite element 40 and the base 21A is established, the copper is also deposited on the surface of the base which is not protected by the third layer 56 and by the support 123 as such making it possible to finish forming the second metal deposit 52.

The deposition of the copper can be carried out at a constant current of 10 mA for a duration ranging from 5 to 6 h. With such a deposition condition the voltage supplied by the source of current 121 is between 0.3 and 0.4 V.

During the step of neutralising, the latter can be carried out by means of a bath in a solution of 10% sodium hydroxide during a duration ranging from 12 h to 72 h. It can be noted that with a duration of 72 h, the step of removing the third layer 56 is not necessary. Indeed, such a bath is sufficient to fully remove the epoxy resin from the first and third protective layers 42 and 56. Note that this removing of the third protective layer 56 as such makes it possible to release the screw passages of the base 21A and authorizes a good electrical connection between the shielding 20 of the coaxial connector 1 and the ground plane of the electrical device 5. Of course, although the removal of the layer 56 is generally necessary, that of the first protective layer 42 has no incidence on the operation of the coaxial connector 1.

In the case where it is provided to remove the third layer 56, the step of removing can be done either chemically, i.e. by using a suitable solvent, or physically, i.e. an operation of scraping the third layer. It can be noted, regardless of the method retained, this operation is facilitated by the prior step of neutralising which makes it possible to weaken the third layer 56.

According to the alternative of the first embodiment wherein the graphite element does not have the first protective layer 42, a step of removing the first layer 42 of the same type as the step of removing the third layer 56 can be provided.

Figure 9:
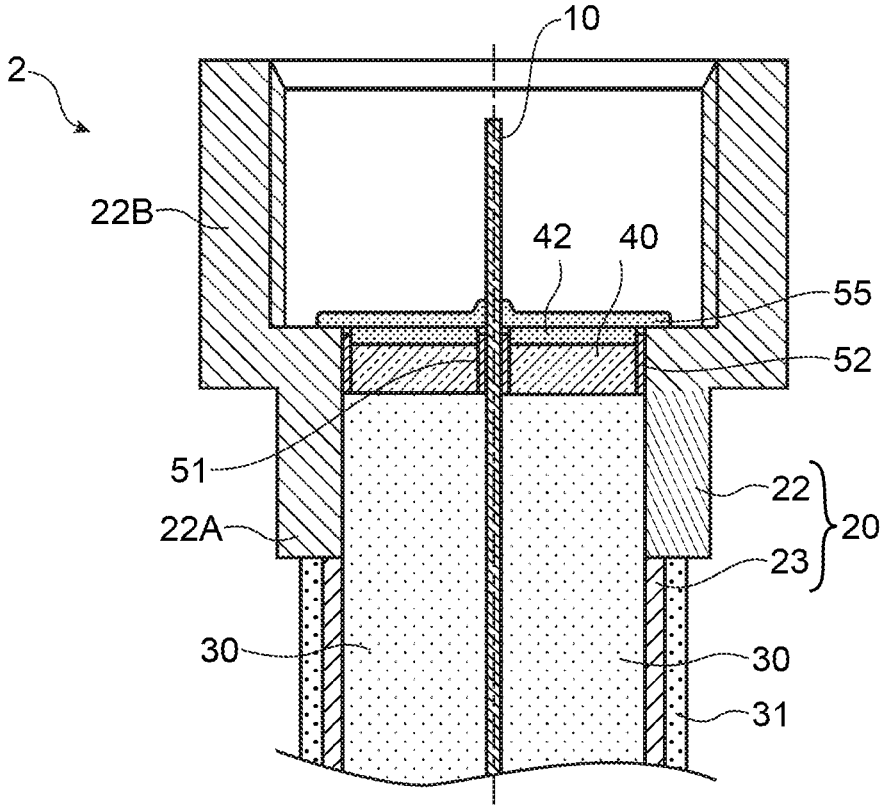
FIG. 9 shows a coaxial connector according to a third embodiment according to the invention wherein the coaxial connector is of the male type, said coaxial connector provided on a coaxial cable.

FIG. 9 partially shows a coaxial cable according to a second embodiment of the invention. Such a coaxial cable is provided with a coaxial connector 2 of the male SMA type in accordance with the first embodiment. Such a coaxial connector 2 is differentiated from the coaxial connector 1 according to the first embodiment by the shape of the connection endpiece 20 which is a connection endpiece of the male type and by the installation thereof at an end of the coaxial cable.

With such an installation of the coaxial connector 2 at the end of the coaxial cable, the coaxial connector 2 comprises a core 10 and a dielectric 30 which are common with the coaxial cable, and the connection endpiece 22 is electrically connected to the shielding 23 of the coaxial cable which itself is coated with a dielectric coating 31.

As the connection endpiece 22 according to this third embodiment comprises a first cylindrical hollow portion 22A of revolution of which the inner diameter is substantially equal to the diameter of the dielectric 30 in such a way as to house a portion thereof. The connection endpiece 22 also comprises, in the extension of the first cylindrical portion 22A a second cylindrical hollow portion 22B of revolution that has an inner diameter greater than that of the first cylindrical portion 22A while still being coaxial to it. The first and second cylindrical portions 22A, 22B are connected to one another by a shoulder.

The second cylindrical portion 22B has a threading on its inner surface, in such a way as to authorize the screwing of the cylindrical body of a complementary coaxial connector. As such the coaxial connector 2 is shaped to cooperate with a complementary endpiece, such as the one shown in FIG. 1, of another coaxial connector according to a cooperation of the male/female type.

The second cylindrical portion 22B is empty except for the core 10 which protrudes from the first cylindrical portion 22A. The first cylindrical portion 22A houses, in addition to the dielectric 30 and the core 10, the graphite element 40 covered with the first protective layer 10. In this way, the graphite element 40 is positioned between the core 10 and the first cylindrical portion 22A.

The first and second metal deposits 51, 52 are positioned between the graphite element 40 and respectively the core 10 and the first cylindrical portion 22A.

With such a configuration, it is possible with a single coaxial cable comprising the coaxial connector 2 according to this third embodiment to protect several measuring devices intended to be connected in turn by means of the coaxial cable 3 to a measuring system that generates high current pulses over very short periods of time, this by benefitting from the integration of the shunt according to the invention.

The method of manufacturing a coaxial connector 2 according to this second embodiment is differentiated from the method of manufacturing a coaxial connector 1 according to the first embodiment by the protection to be provided to the connector 2 during the step of forming the first and the second metal deposits 51, 52 and by an adaptation of the tool used to insert via shearing the graphite element that has to have a shape that is complementary to the connection endpiece 22.

Indeed, in order to provide a retaining of the conformation in order to cooperate with a complementary endpiece of the endpiece, it is necessary that the inner surface of the second cylindrical portion 22B be protected during the step of forming of the first and second metal deposit 51, 52. Such a protection can be obtained in the same way as in the first embodiment by means of a layer similar to the third protective layer 56 described hereinabove.

The invention claimed is:

1. A coaxial connector comprising:

a conductive core;

a metal shielding surrounding the conductive core;

a dielectric arranged between the conductive core and the metal shielding to insulate them electrically with respect to one another; and a shunt to supply a resistive bridge between the conductive core and the metal shielding;

wherein the shunt comprises:

a graphite element positioned between the conductive core and the metal shielding; and a first and a second metal deposit to supply an electrical and mechanical connection between the graphite element and respectively the conductive core and the metal shielding, each one of the first and second metal deposits being an electrolytic deposit.

2. The coaxial connector according to claim 1, wherein each one of the first and second metal deposits is made from a metal selected from the group of copper, silver, gold, nickel, chrome, zinc, tin, and lead.

3. The coaxial connector according to claim 1, wherein at least one of the first and second metal deposits is made of copper.

4. The coaxial connector according to claim 1, wherein at least one of the first and second metal deposits comprises at least two layers of metal, each one of the layers being made from a metal selected from the group of copper, silver, gold, nickel, chrome, zinc, tin, and lead.

5. The coaxial connector according to claim 1 further comprising a second protective layer to protect at least one of the first and second metal deposits.

6. The coaxial connector according to claim 1, wherein the graphite element has a form of a graphite plate sized to be positioned between the conductive core and the metal shielding.

7. The coaxial connector according to claim 5, wherein the graphite element has a thickness between 5 and 250 μm.

8. The coaxial connector according to claim 1, wherein the metal shielding comprises a metal connection endpiece shaped to cooperate with a complementary endpiece of another coaxial connector according to a cooperation of male/female type, and wherein the graphite element is positioned between the conductive core and the metal connection endpiece, the second metal deposit providing an electrical and mechanical connection between the graphite element and the metal connection endpiece.

9. The coaxial connector according to claim 1, wherein the coaxial connector is a connector of SMA type, the metal connection endpiece being a threaded endpiece.

10. A coaxial cable comprising at least one coaxial connector according to claim 1.

11. An electrical device comprising at least one coaxial connector according to claim 1.

12. A method for manufacturing the coaxial connector according to claim 1, the method comprising:

supplying the coaxial connector;

supplying the graphite element;

installing the graphite element on the coaxial connector positioned between the conductive core and the metal shielding; and forming the first and the second metal deposits to supply an electrical and mechanical connection between the graphite element and respectively the conductive core and the metal shielding, the forming of the first and second metal deposit being carried out by electrolysis.

13. The method for manufacturing according to claim 12, further comprising protecting a face of the graphite element by a first protective layer, the protecting of the face of the graphite element being prior to the forming the first and second metal deposits;

wherein forming the first and second metal deposits carries out an electrolytic deposit between the graphite element and respectively the conductive core and the metal shielding, the face of the graphite element being protected by the first layer.

14. The method for manufacturing according to claim 12, further comprising depositing a second protective layer to protect the first and second metal deposits.

15. The method for manufacturing according to claim 12, wherein during supplying the graphite element, the graphite element is oversized, and installing the graphite element comprises inserting the graphite element via shearing to place the graphite element between the conductive core and the metal shielding with a suitable sizing.

16. A coaxial connector comprising:

a conductive core;

a metal shielding surrounding the conductive core;

a dielectric material arranged between the conductive core and the metal shielding to insulate them electrically with respect to one another; and a shunt to supply a resistive bridge between the conductive core and the metal shielding, wherein the shunt comprises:

an annular graphite element made of graphite positioned between the conductive core and the metal shielding; and a first and a second metal deposit to supply an electrical and mechanical connection between the graphite element and respectively the conductive core and the metal shielding, each one of the first and second metal deposits being an electrolytic deposit, the graphite element forming the resistive bridge between the conductive core and the metal shielding.

* * * * *